US010159373B2

(12) United States Patent
Sugimoto et al.

(10) Patent No.: US 10,159,373 B2
(45) Date of Patent: Dec. 25, 2018

(54) RECEPTION BOX

(71) Applicant: F and F CO., LTD., Ome, Tokyo (JP)

(72) Inventors: Masatsugu Sugimoto, Ome (JP); Tsutomu Kurosawa, Ome (JP)

(73) Assignee: F AND F CO., LTD., Tokyo (JP)

( * ) Notice: Subject to any disclaimer, the term of this patent is extended or adjusted under 35 U.S.C. 154(b) by 0 days.

(21) Appl. No.: 15/908,276

(22) Filed: Feb. 28, 2018

(65) Prior Publication Data

US 2018/0338634 A1 Nov. 29, 2018

(30) Foreign Application Priority Data

May 26, 2017 (JP) ..... 2017-002359 U
Jul. 31, 2017 (JP) ..... 2017-003527 U

(51) Int. Cl.
*A47G 29/20* (2006.01)

(52) U.S. Cl.
CPC ..... *A47G 29/20* (2013.01)

(58) Field of Classification Search
CPC ..... A47G 29/12; A47G 29/1209; A47G 29/12097; A47G 29/124; A47G 29/20; A47G 2029/1228; A47G 2029/148; A47B 88/90
USPC ..... 232/17, 19, 29, 34–36, 38, 45, 43.4; 312/211, 212, 330.1
See application file for complete search history.

(56) References Cited

U.S. PATENT DOCUMENTS 3,033,443 A * 5/1962 Barnes ..... A47G 29/121 232/34
4,089,460 A * 5/1978 Mellard ..... A47G 29/121 232/34
4,844,332 A * 7/1989 Long ..... A47G 29/1209 232/17
5,125,570 A * 6/1992 Jones ..... A47G 29/1205 232/1 C
5,335,848 A * 8/1994 Schreiber ..... A47G 29/1205 232/34
5,564,624 A * 10/1996 Davis, Jr. ..... A47G 29/1201 232/17
5,586,718 A * 12/1996 Speece ..... A47G 29/1209 232/17
5,664,728 A * 9/1997 Jones ..... A47G 29/1225 200/61.63
5,678,757 A * 10/1997 Martin ..... A47G 29/1216 232/17
5,950,919 A * 9/1999 Adams ..... A47G 29/1214 232/17

(Continued)

*Primary Examiner* — William L Miller
(74) *Attorney, Agent, or Firm* — Knobbe, Martens, Olson & Bear, LLP

(57) ABSTRACT

A reception box includes: a casing; a first door that is provided in the casing, and is opened and closed by a sender; a second door that is provided in the casing, and is opened and closed by a receiver; and a loading platform that is provided inside the casing with at least the first door in a closed state. The loading platform includes a first bed portion on the first door side, a second bed portion on the opposite side of the first bed portion, and a rotation shaft provided between the first bed portion and the second bed portion. The first bed portion moves up and the second bed portion moves down when a parcel is placed on the loading platform. The first door is locked when the first door is closed with the parcel placed on the loading platform.

8 Claims, 8 Drawing Sheets

(56) References Cited

U.S. PATENT DOCUMENTS

| | | | | |
|---|---|---|---|---|
| 8,336,759 | B2 * | 12/2012 | Skouboe | A47G 29/20<br>232/45 |
| 2012/0031960 | A1 * | 2/2012 | Skouboe | A47G 29/16<br>232/47 |

* cited by examiner

RECEPTION BOX

INCORPORATION BY REFERENCE

The disclosure of JP2017-2359U filed on May 26, 2017, and JP2017-3527U filed on Jul. 31, 2017 are incorporated in this specification by reference.

BACKGROUND OF THE INVENTION

Field of the Invention

The present disclosure is related to a reception box that can be used as a delivery box for delivering a parcel, for example.

Description of the Related Art

A delivery box for storing a parcel delivered by a delivery service during absence of a receiver has been known. After placing the parcel in the delivery box, the delivery service notifies the receiver of the parcel. When the receiver having received the notification comes home, he/she inputs a password, for example, to open a door of the delivery box and receive the parcel. Thus, a conventional delivery box that has a complex mechanism is sometimes unable to receive input of a password at the time of a power outage, for example.

The present disclosure has been made in view of such circumferences, and aims to provide a reception box that, even though having a simple structure, prevents anyone other than the receiver from taking out a parcel stored therein.

SUMMARY OF THE INVENTION

A first reception box of the present disclosure includes: a casing; a first door that is provided in the casing, and is opened and closed by a sender; a second door that is provided in the casing, and is opened and closed by a receiver; and a loading platform that is provided inside the casing with at least the first door in a closed state. The loading platform includes a first bed portion on the first door side, a second bed portion on the opposite side of the first bed portion, and a rotation shaft provided between the first bed portion and the second bed portion. The first bed portion moves up and the second bed portion moves down when a parcel is placed on the loading platform. The first door is locked when the first door is closed with the parcel placed on the loading platform.

A second reception box of the present disclosure includes: a casing; a first door that is provided on at least a face of a side of the casing, and is opened and closed by a sender; a second door that is provided in the casing, and is opened and closed by a receiver; and a loading platform that is provided on the inner side of the casing, and on which a parcel is placed. The loading platform is a seesaw configured of a first bed portion on the first door side, a second bed portion on the opposite side of the first bed portion, and a rotation shaft provided between the first bed portion and the second bed portion. The first bed portion moves up and the second bed portion moves down when a parcel is placed on the loading platform. The first door is locked onto the first bed portion when the first door is closed with the parcel placed on the loading platform.

A third reception box of the present disclosure includes: a casing; a drawer that is provided in the casing, is opened and closed by a sender, and includes a front plate; a loading platform that is provided inside the drawer; and a door that is provided in the casing, and is opened and closed by a receiver. The loading platform includes a bed portion, and a rotation shaft provided below the bed portion. The bed portion includes a first bed portion on a front plate side of the rotation shaft, and a second bed portion on the opposite side of the first bed portion. The first bed portion moves up and the second bed portion moves down when a parcel is placed on the bed portion. The drawer is locked onto the casing when the drawer is closed with the parcel placed on the bed portion.

Aforementioned and other objectives, characteristics, and advantages of the present application will become apparent from the following detailed description with reference to the accompanying drawings that exemplify the present application.

DETAILED DESCRIPTION OF THE PREFERRED EMBODIMENTS

Figure 1:
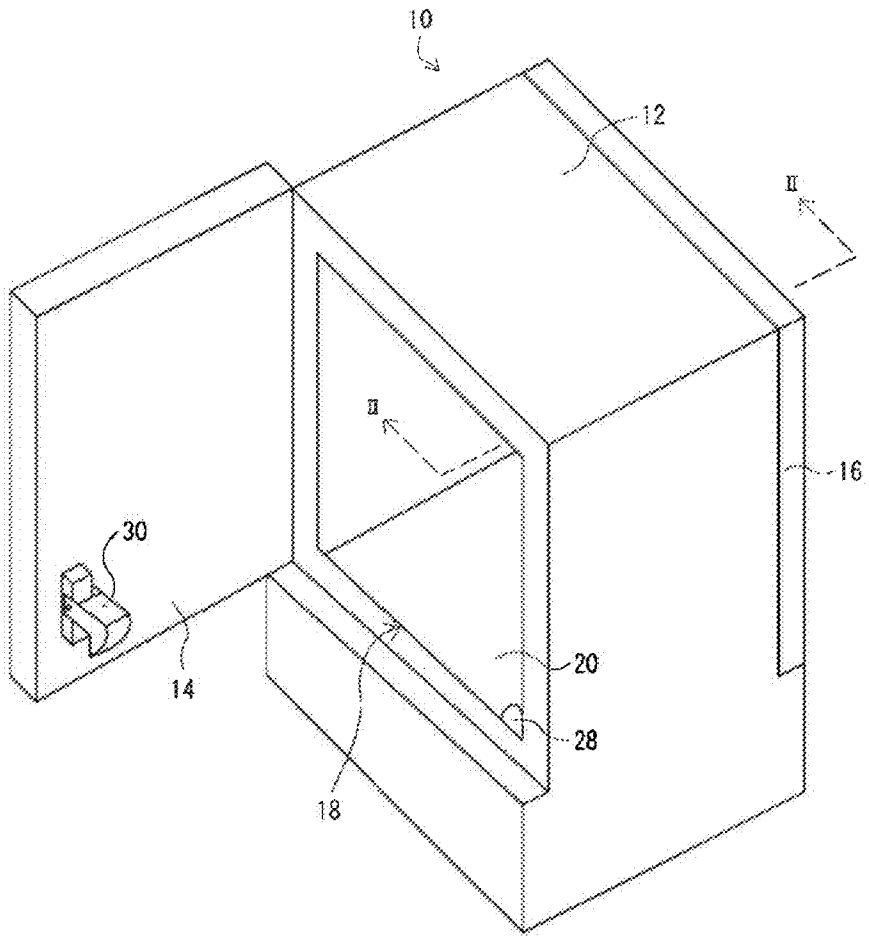
FIG. 1 is a perspective view of a reception box of a first embodiment of the present disclosure.

Hereinafter, two embodiments of the present disclosure will be described. A first embodiment will first be described, and a second embodiment will next be described.

The First Embodiment

Hereinafter, reception box 10 of the first embodiment will be described with reference to the drawings. Note that the drawings schematically illustrate reception box 10, later-mentioned members constituting reception box 10, and members surrounding reception box 10. Actual dimensions and dimensional ratios of the members do not necessarily match the dimensions and dimensional ratios in the drawings. Additionally, in the following description, overlapping contents are omitted as appropriate, and the same members are sometimes assigned the same reference characters.

Reception box 10 of the embodiment may be used as a mailbox, a container of a gift from a neighbor, or a delivery box for storing parcel B delivered by a delivery service, for example. As illustrated in FIG. 1, reception box 10 is a rectangular parallelepiped-shaped box-like object including casing 12, first door 14, second door 16, and loading platform 18. Note that reception box 10 may be a box-like object formed into a cylinder such as a circular column and a polygonal column, a cone such as a circular cone and a polygonal cone, or a frustum, for example.

Figure 2:
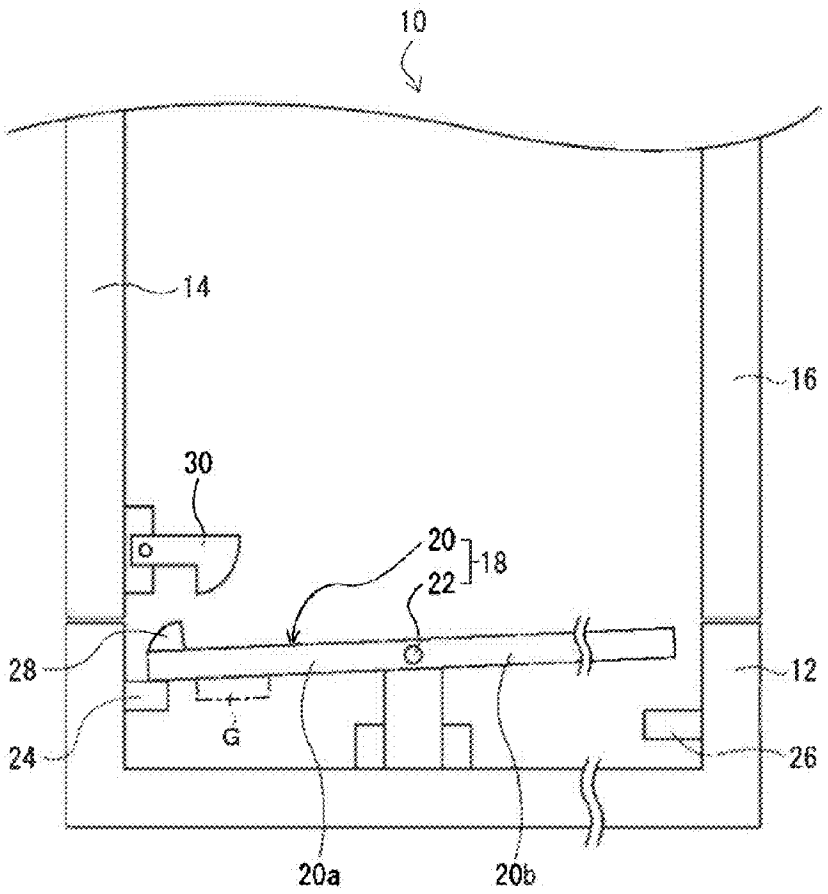
FIG. 2 is a partial cross-sectional view of the reception box of the first embodiment.

FIG. 1 is a perspective view of reception box 10 when first door 14 is open. FIG. 2 is a partial cross-sectional view of reception box 10 cut vertically along line II-II of FIG. 1. Note that first door 14 is closed in FIG. 2. Casing 12 is a hollow rectangular parallelepiped-shaped member that has openings in parts where first door 14 and second door 16 are provided. First door 14 is provided on a face of a side of casing 12, and is opened and closed by a sender. Note that a sender refers not only to the sender himself/herself, but also to an individual, a group, and the like on the sender's side such as a family member or an agent of the sender, the postal service, or a delivery service.

Second door 16 is provided on a face of a side of casing 12, and is opened and closed by a receiver. A receiver refers not only to the receiver himself/herself, but also to an individual, a group, and the like on the receiver's side such as a family member or an agent of the receiver, or a member of a group, for example, if the receiver is a group. A lock mechanism (not illustrated) is provided between second door 16 and casing 12. The receiver can lock and unlock second door 16 by using the lock mechanism. In the embodiment, second door 16 is provided on a side of a face of casing 12 that faces first door 14. Note, however, that second door 16 may be provided on a side of a face of casing 12 that is adjacent to first door 14, or may be provided on a face of a top instead of a side of a face of casing 12. Instead, first door 14 and second door 16 may straddle a side of a face and on a top of casing 12.

Casing 12, first door 14, and second door 16 include a Styrofoam layer and a cover layer covering at least a part of the Styrofoam layer. Thus, in the embodiment, main members that appear on the outside of reception box 10 have a heat insulating property. Hence, parcel B stored in reception box 10 is less likely to be affected by outdoor temperature. Accordingly, even if an electronic part or the like is stored in reception box 10 in midsummer, for example, the electronic part or the like is less likely to become defective. Even if agricultural produce harvested by a neighbor is stored in reception box 10, the agricultural produce is less likely to go bad. Note that casing 12, first door 14, and second door 16 may be formed of metal, wood, resin, or concrete, for example.

As illustrated in FIG. 2, loading platform 18 is formed of metal plate-like member 20 and shaft-like member 22, for example, and parcel B is placed thereon. Note that the material, shape and the like of plate-like member 20 and shaft-like member 22 are not particularly limited. Shaft-like member 22 is placed horizontally and parallel to closed first door 14. When there is no parcel B on loading platform 18, plate-like member 20 is supported by shaft-like member 22 such that a face of a top of plate-like member 20 is substantially horizontal. In the embodiment, plate-like member 20 and shaft-like member 22 constitute a seesaw.

Specifically, of plate-like member 20, first bed portion 20*a* on first door 14 side and second bed portion 20*b* on the opposite side of first bed portion 20*a* rotate within a vertical plane, around shaft-like member 22 serving as a rotation shaft between first bed portion 20*a* and second bed portion 20*b*. In other words, on both sides across shaft-like member 22, when first bed portion 20*a* moves up, second bed portion 20*b* moves down, and when second bed portion 20*b* moves up, first bed portion 20*a* moves down. Note that casing 12 includes first stopper 24 that restricts downward movement of first bed portion 20*a*. Casing 12 also includes second stopper 26 that restricts downward movement of second bed portion 20*b*. Since first stopper 24 and second stopper 26 are provided, plate-like member 20 moves within a minimal range. Hence, malfunction and failure of plate-like member 20 can be prevented.

Figure 3:
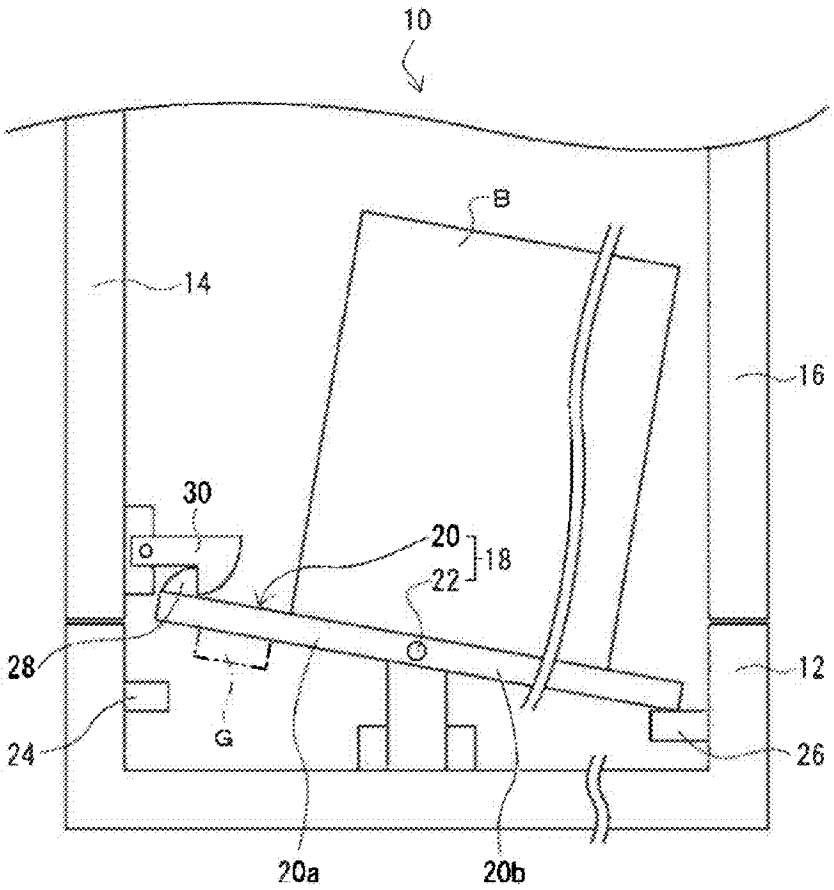
FIG. 3 is a partial cross-sectional view of the reception box of the first embodiment when a parcel is stored therein.

FIG. 3 illustrates how reception box 10 stores parcel B. In reception box 10, when parcel B is placed on loading platform 18, the weight of parcel B lowers second bed portion 20*b* and lifts first bed portion 20*a*. In other words, loading platform 18 is configured such that second bed portion 20*b* moves down and first bed portion 20*a* moves up when parcel B is placed on loading platform 18. Such loading platform 18 is formed by appropriately selecting the material, shape, and the like of plate-like member 20, and adding a mark and a weight to plate-like member 20 or providing rotation restriction means for plate-like member 20, for example.

For example, weight G may be attached below first bed portion 20*a* (see FIG. 2), to keep first bed portion 20*a* from moving up when there is no parcel B in reception box 10. Additionally, a mark (not illustrated) indicating an installation area or the center of installation of parcel B, for example, may be provided on a face of a top of second bed portion 20*b*, to ensure lowering of second bed portion 20*b* when parcel B is stored in reception box 10. In the embodiment, first door 14 is locked onto first bed portion 20*a*, when first door 14 is closed with parcel B placed on loading platform 18.

As illustrated in FIGS. 2 and 3, first bed portion 20*a* includes fan-shaped member 28 which is an upward protrusion. First door 14 includes hook 30 which is an accommodation part that accommodates fan-shaped member 28 (or meshes with fan-shaped member 28). Note that the material, shape, and the like of the protrusion and the accommodation part are not particularly limited. Hook 30 is capable of rotating upward from a position where its major axis is horizontal. As illustrated in FIG. 3, first door 14 is locked onto first bed portion 20*a*, that is, first door 14 becomes unopenable when fan-shaped member 28 is accommodated in hook 30. This makes it difficult to steal parcel B in reception box 10. In addition, since reception box 10 is locked by first bed portion 20*a* with this simple structure, the delivery service does not need to provide the receiver with a password, for example.

Figure 4:
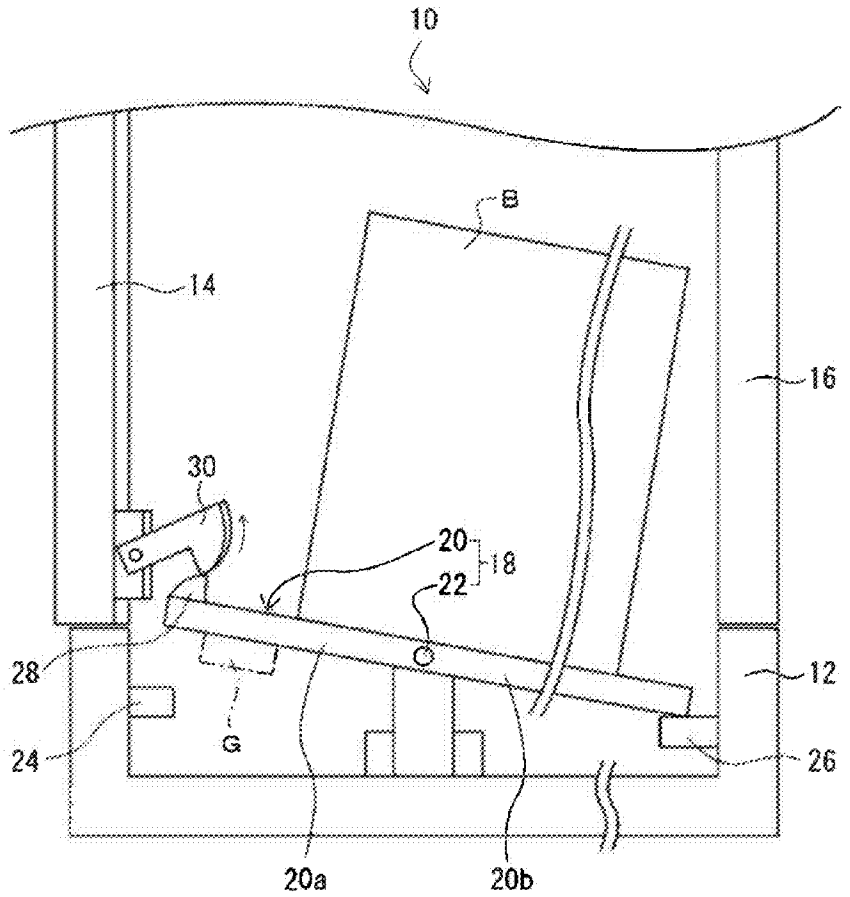
FIG. 4 is a partial cross-sectional view for describing a lock mechanism of the reception box of the first embodiment.

FIG. 4 illustrates an action until first door 14 is locked onto first bed portion 20*a*. When first door 14 is opened and parcel B is placed on loading platform 18, first bed portion 20*a* moves up, and second bed portion 20*b* moves down. Accordingly, fan-shaped member 28 is positioned above the lower edge of an opening portion of first door 14 of casing 12. Then, when first door 14 is closed, hook 30 rotates upward while being in contact with fan-shaped member 28, as illustrated in FIG. 4. Then, when first door 14 is closed completely, first door 14 is locked onto first bed portion 20*a* when fan-shaped member 28 is accommodated in hook 30, as illustrated in FIG. 3. Thus, first door 14 becomes unopenable. The receiver opens second door 16 and takes out parcel B.

The first embodiment has been described above.

The Second Embodiment

Next, reception box 50 of a second embodiment will be described with reference to the drawings. Note that the drawings schematically illustrate reception box 50, later-mentioned members constituting reception box 50, and members surrounding reception box 50. Actual dimensions and dimensional ratios of the members do not necessarily match the dimensions and dimensional ratios in the drawings. Additionally, in the following description, if not particularly stated, directions such as "up" and "down" are indicated based on the direction of reception box 50 illustrated in FIG. 5 for convenience. In the following description, overlapping contents are omitted as appropriate, and the same members are sometimes assigned the same reference characters.

As in the case of reception box 10 of the first embodiment, reception box 50 of the embodiment may be used as a delivery box, and the like. Reception box 50 is a rectangular parallelepiped-shaped box-like object including casing 52, drawer 54, loading platform 56, and door 58 (one example of second door). Note that reception box 50 may be a box-like object formed into a cylinder such as a circular column and a polygonal column, a cone such as a circular cone and a polygonal cone, or a frustum, for example.

Figure 5:
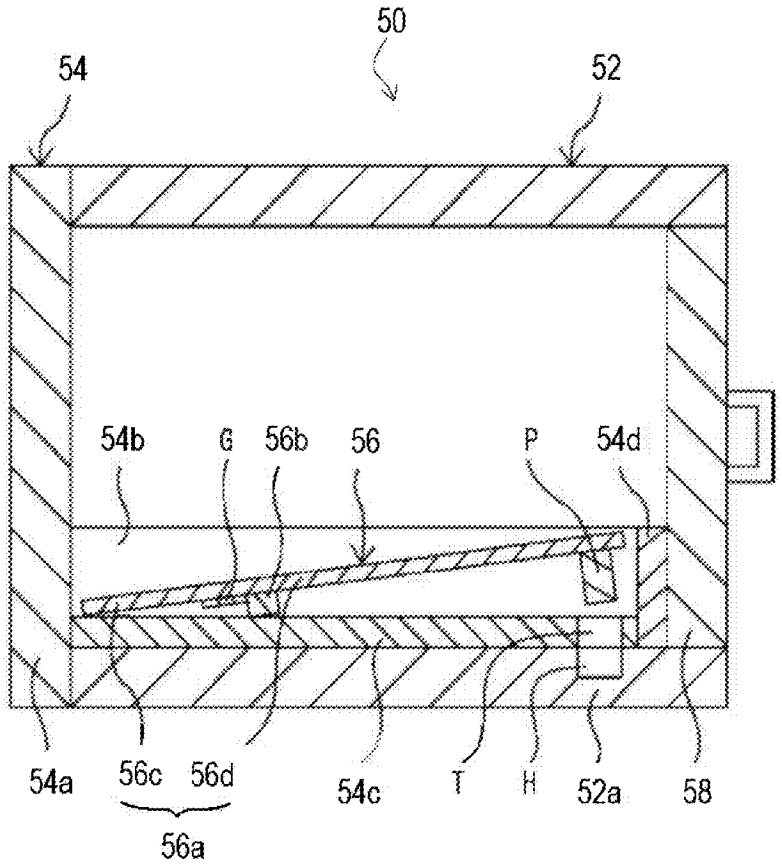
FIG. 5 is a schematic cross-sectional view of a reception box of a second embodiment of the present disclosure, when its drawer that does not contain any parcels is closed.
Figure 6:
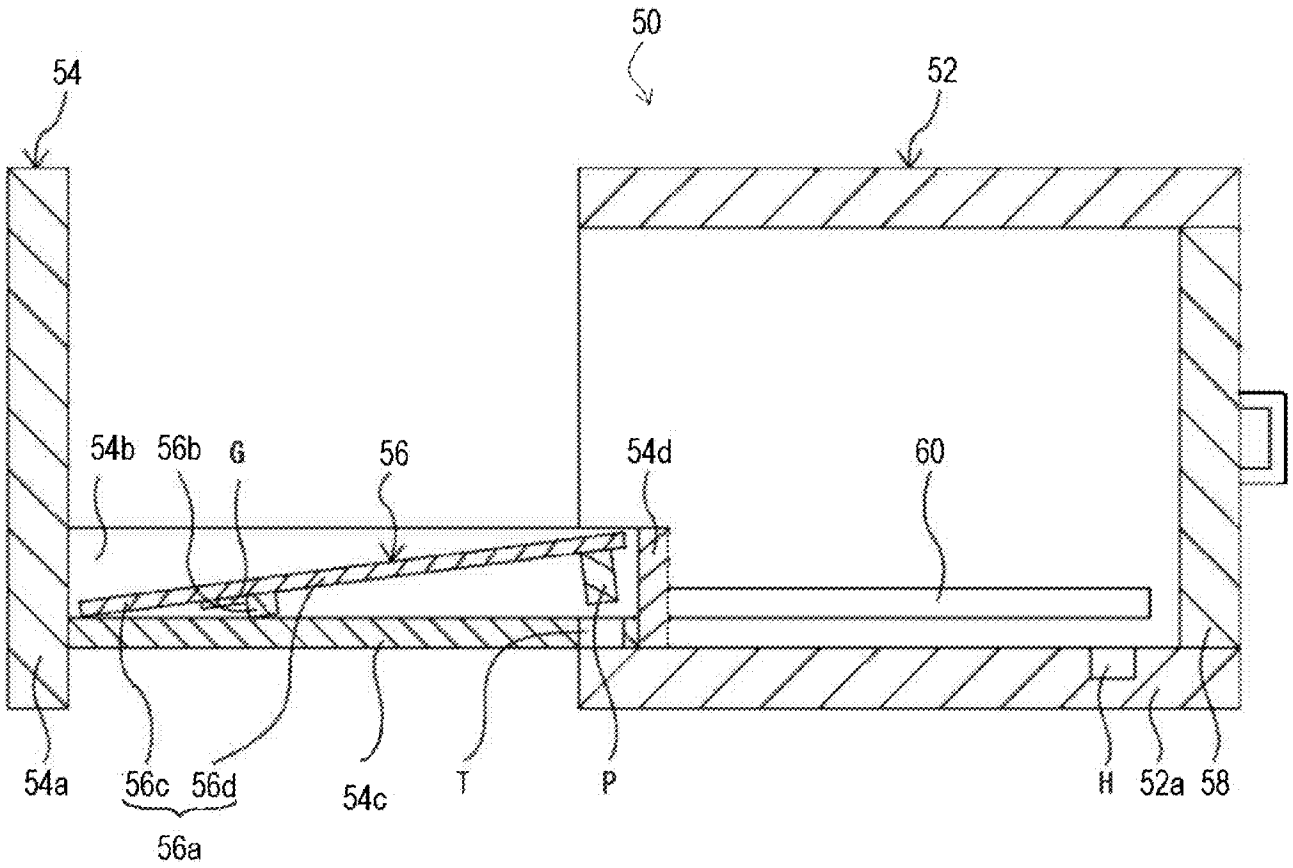
FIG. 6 is a schematic cross-sectional view of the reception box of the second embodiment, when its drawer that does not contain any parcels is open.

FIG. 5 illustrates a vertical cross section of reception box 50, when drawer 54 that does not contain parcel B is closed. FIG. 6 illustrates a vertical cross section of reception box 50, when drawer 54 that does not contain parcel B is open. Casing 52 is a hollow rectangular parallelepiped-shaped member that has openings in parts where drawer 54 and door 58 are provided. Casing 52 includes bottom portion 52*a*. As illustrated in FIG. 5, drawer 54 is provided inside casing 52. Additionally, drawer 54 (and later-mentioned front plate 54*a*) is opened and closed by a sender.

Drawer 54 includes front plate 54*a* (one example of first door), pair of side plates 54*b*, bottom plate 54*c*, and tip plate 54*d*. Front plate 54*a* closes the opening of casing 52. A pull (not illustrated) such as a knob, a handle, and a concave as a drawer pull is provided in front plate 54*a* to facilitate opening and closing of drawer 54.

To reduce weight and material of drawer 54, in the embodiment, the height (length in an up-down direction) of each side plate 54*b* is shorter than the height (length in an up-down direction) of front plate 54*a*. Of course, the height of each side plate 54*b* may be about the same as the height of front plate 54*a*, as a matter of course. Also, as will be described later, parcel B is taken out from tip plate 54*d* side of drawer 54. Hence, the upper end of tip plate 54*d* is positioned lower than the upper end of front plate 54*a*, so that parcel B can be taken out more easily. Note that while the upper end of tip plate 54*d* is at the same position as the upper end of each side plate 54*b*, the upper end of tip plate 54*d* may be positioned lower than the upper end of each side plate 54*b*, or the tip plate 54*d* itself may be eliminated.

Loading platform 56 is provided inside drawer 54. In the embodiment, loading platform 56 is provided on bottom plate 54*c*. Note that bottom plate 54*c* may be eliminated from drawer 54, and loading platform 56 may be supported by side plates 54*b*. Loading platform 56 includes plate-like bed portion 56*a* on which parcel B is placed, and support member 56*b* provided below bed portion 56*a*. In the embodiment, bed portion 56*a* and support member 56*b* serving as a rotation shaft constitute a seesaw.

Bed portion 56*a* includes first bed portion 56*c* on a front plate 54*a* side of support member 56*b*, and second bed portion 56*d* on the opposite side of first bed portion 56*c*. Bed portion 56*a* does not necessarily have to be formed into a plate, and may be formed into a net, a basket, a grid, or the like, as long as parcel B can be placed thereon. In reception box 50, when parcel B is placed on bed portion 56*a*, first bed portion 56*c* moves up and second bed portion 56*d* moves down. When drawer 54 is closed with parcel B placed on bed portion 56*a*, drawer 54 is locked onto casing 52. The mechanism of locking drawer 54 onto casing 52 will be described later. In the embodiment, two circular column-shaped downward protrusions P are provided on a lower face of second bed portion 56*d*. In addition, circular column-shaped holes H that are larger than protrusions P are provided in a face of a top of bottom portion 52*a*. Through holes T, that protrusions P penetrate, are provided in bottom plate 54*c*.

Pair of casing-side rails 60 are provided in casing 52. A pair of drawer-side rails (not illustrated) to be attached to pair of casing-side rails 60 are provided in side plates 54*b*, respectively. As illustrated in FIG. 6, when front plate 54*a* is pulled out by the sender, for example, the drawer-side rails move along casing-side rails 60, and drawer 54 opens. A known stopper mechanism (not illustrated) is provided between casing-side rails 60 and the drawer-side rails, and the stopper mechanism prevents drawer 54 from falling off casing 52. Note that the stopper mechanism may be released to pull drawer 54 out of casing 52.

Door 58 is provided in a face of a side of casing 52, and is opened and closed by a receiver. A lock mechanism (not illustrated) is provided between door 58 and casing 52. The receiver can lock and unlock door 58 by use of the lock mechanism. Parcel B that is placed in reception box 50 by the sender is taken out by the receiver by opening door 58. In the embodiment, door 58 is provided on a face of a side of casing 52 that faces front plate 54*a* of drawer 54. Note, however, that door 58 may be provided on a face of a side of casing 52 that is adjacent to drawer 54, or may be provided on a face of a top of casing 52 instead of a face of a side of casing 52. Instead, door 58 may straddle a face of a side and on a top of casing 52.

Casing 52, drawer 54, and door 58 include a Styrofoam layer and a cover layer covering at least a part of the Styrofoam layer. Thus, in the embodiment, main members that appear on the outside of reception box 50 have a heat insulating property. Hence, parcel B stored in reception box 50 is less likely to be affected by outdoor temperature. Accordingly, even if an electronic part or the like is stored in reception box 50 in midsummer, for example, the electronic part or the like is less likely to become defective. Even if agricultural produce harvested by a neighbor is stored in reception box 50, the agricultural produce is less likely to go bad. Note that casing 52, drawer 54, and door 58 may be formed of metal, wood, resin, or concrete, for example.

Figure 7:
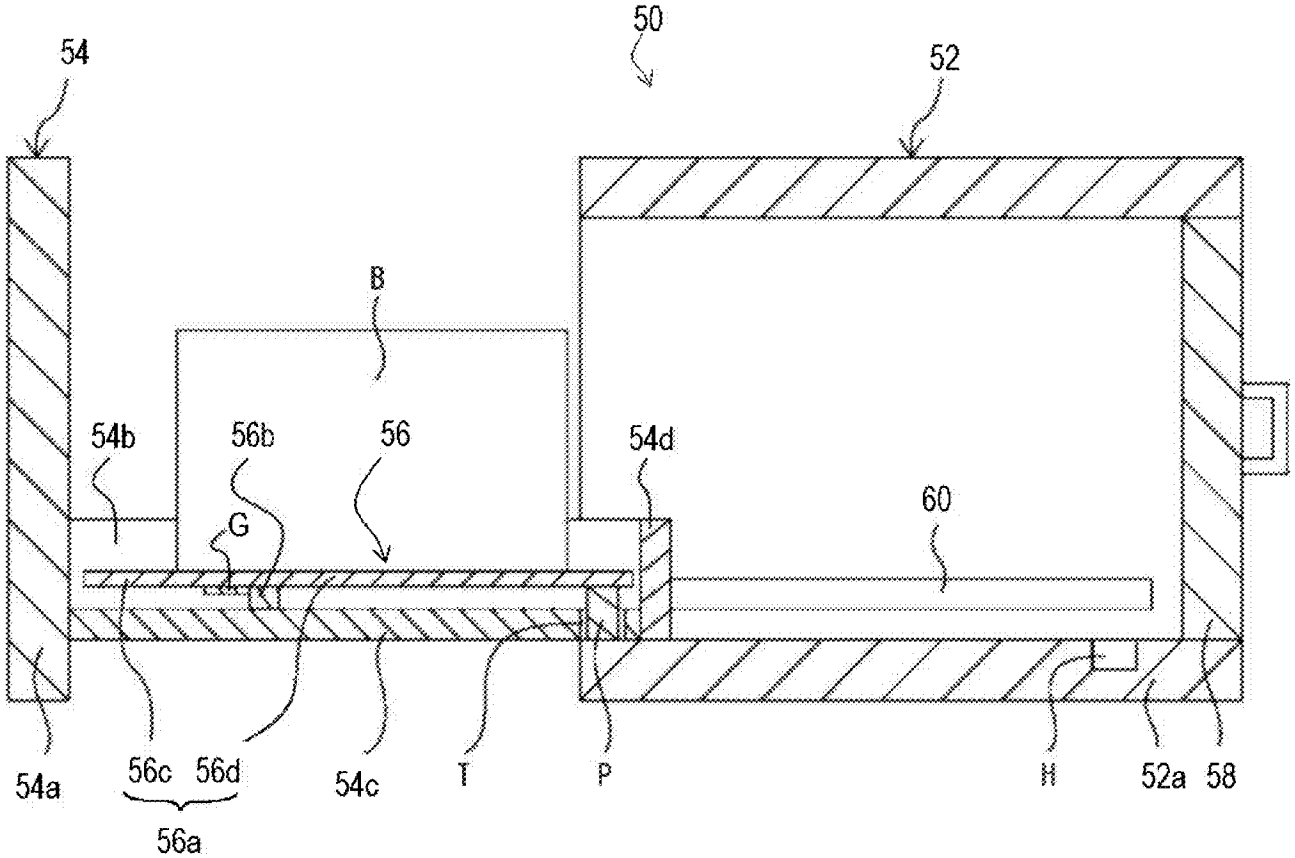
FIG. 7 is a schematic cross-sectional view of the reception box of the second embodiment, when its drawer that contains a parcel is open.
Figure 8:
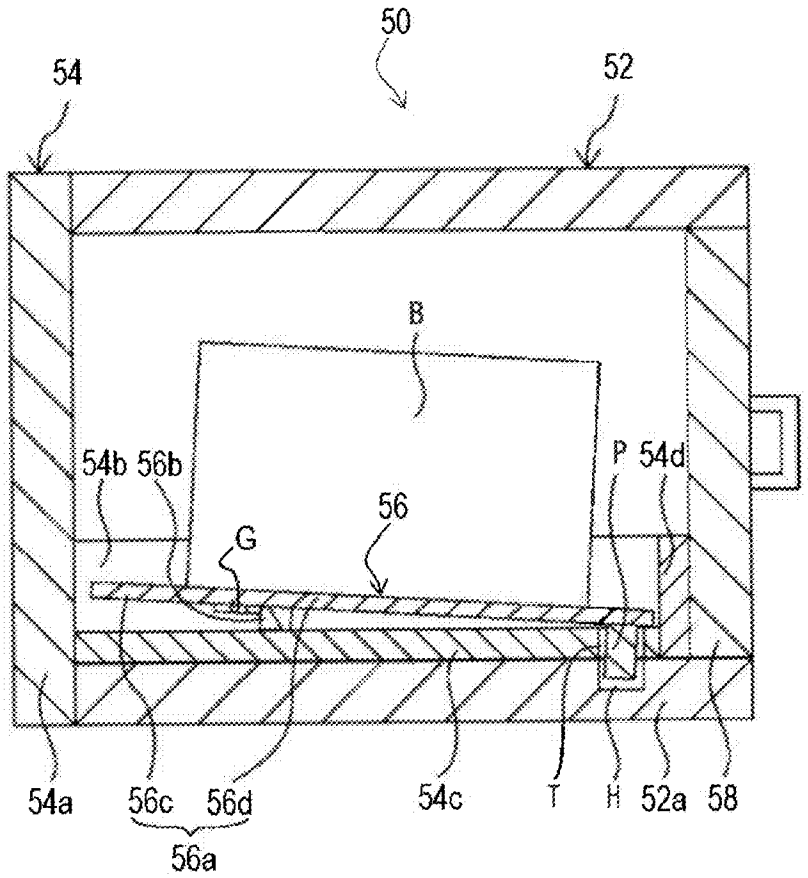
FIG. 8 is a schematic cross-sectional view of the reception box of the second embodiment, when its drawer that contains a parcel is closed.

Actions of a sender when he/she opens drawer 54 of reception box 50, places parcel B in drawer 54, and closes drawer 54 will be described with reference to FIGS. 6 to 8. FIG. 7 illustrates a vertical cross section of reception box 50, when drawer 54 containing parcel B is open. FIG. 8 illustrates a vertical cross section of reception box 50, when drawer 54 containing parcel B is closed. First, as illustrated in FIG. 6, the sender opens drawer 54. Since parcel B is not placed on loading platform 56, first bed portion 56*c* is kept down by weight G provided on a lower face of first bed portion 56*c*, and second bed portion 56*d* is kept up.

Next, as illustrated in FIG. 7, the sender places parcel B on loading platform 56 in drawer 54. As a result, the weight of parcel B lowers second bed portion 56*d*, and lifts first bed portion 56*c*. In other words, in the embodiment loading platform 56 is configured such that second bed portion 56*d* moves down and first bed portion 56*c* moves up when parcel B is placed on bed portion 56*a*. Such loading platform 56 can be formed by appropriately selecting the material and shape of first bed portion 56*c* and second bed portion 56*d*, and the position of support member 56*b*, for example.

Additionally, a marking that indicates an installation area or the center of installation of parcel B, for example, may be provided on a face of a top of second bed portion 56*d*, to ensure lowering of second bed portion 56*d* when parcel B is stored in reception box 50.

As illustrated in FIG. 7, when parcel B is placed on bed portion 56*a* and second bed portion 56*d* is lowered, protrusion P penetrates through hole T and comes into contact with bottom portion 52*a*. When the sender closes drawer 54 containing parcel B, protrusion P moves while in contact with bottom portion 52*a*. Then, as illustrated in FIG. 8, protrusion P is accommodated in hole H. When protrusion P is accommodated in hole H, drawer 54 is no longer openable to allow parcel B to be taken out. In other words, drawer 54 is locked onto casing 52. This makes it difficult to steal parcel B in reception box 50. Note that the shape, material, number, and the like of protrusion P, through hole T, and hole H are not particularly limited, as long as the structure locks drawer 54 onto casing 52 when protrusion P is accommodated in hole H. For example, protrusion P, through hole T, and hole H may be formed into a rectangular parallelepiped-shaped form.

Moreover, since drawer 54 is locked onto casing 52 by this simple structure, the delivery service does not need to notify the receiver of a password, for example. Lastly, the receiver opens door 58 and takes out parcel B. When the receiver takes out parcel B, weight G provided on first bed portion 56*c* lifts second bed portion 56*d* and lowers first bed portion 56*c*. Then, when the receiver closes door 58, reception box 50 returns to the state where the sender can open drawer 54 and place parcel B, as illustrated in FIG. 5. Note that multiple reception boxes 50 may be stacked on top of one another, and may be arranged for use according to need. At this time, multiple reception boxes 50 may share a single door 58.

The second embodiment has been described above.

Although some preferred embodiments of the present invention have been illustrated and described in detail, it should be understood that various changes and modification can be made without departing from the gist or scope of the attached claims.

What is claimed is:

1. A reception box comprising:

a casing;

a first door that is provided on at least a face of a side of said casing, and is opened and closed by a sender;

a second door that is provided in said casing, and is opened and closed by a receiver; and a loading platform that is provided on the inner side of said casing, and on which a parcel is placed, wherein:

said loading platform is a seesaw configured of a first bed portion on said first door side, a second bed portion on the opposite side of the first bed portion, and a rotation shaft provided between the first bed portion and the second bed portion;

the first bed portion includes an upward protrusion;

said first door includes an accommodation part that accommodates the protrusion;

the first bed portion moves up and the second bed portion moves down when a parcel is placed on said loading platform; and when said first door is closed with the parcel placed on said loading platform, the protrusion is accommodated in the accommodation part, whereby said first door is locked on to the first bed portion.

2. The reception box according to claim 1, wherein the accommodation part is a hook, the hook being capable of rotating within a vertical plane.

3. The reception box according to claim 1, wherein said casing includes a first stopper that restricts downward movement of the first bed portion.

4. The reception box according to claim 3, wherein said casing includes a second stopper that restricts downward movement of the second bed portion.

5. The reception box according to claim 1, wherein said casing, said first door, and said second door include a Styrofoam layer, and a cover layer that covers at least a part of the Styrofoam layer.

6. A reception box comprising:

a casing;

a drawer that is provided in said casing, is opened and closed by a sender, and includes a front plate;

a loading platform that is provided inside said drawer; and a door that is provided in said casing, and is opened and closed by a receiver, wherein:

said loading platform includes a bed portion, and a rotation shaft provided below the bed portion;

the bed portion includes a first bed portion on a front plate side of the rotation shaft, and a second bed portion on the opposite side of the first bed portion;

a downward protrusion is provided on a bottom face of the second bed portion;

said casing includes an accommodation part that accommodates the protrusion;

the first bed portion moves up and the second bed portion moves down when a parcel is placed on the bed portion; and when said drawer is closed with the parcel placed on the bed portion, the protrusion is accommodated in the accommodation part, whereby said drawer is locked onto said casing.

7. The reception box according to claim 6, wherein a weight is provided on a lower face of the first bed portion.

8. The reception box according to claim 6, wherein said casing, said drawer, and said door include a Styrofoam layer, and a cover layer that covers at least a part of the Styrofoam layer.

* * * * *